US009949055B2

(12) United States Patent
Sato

(10) Patent No.: US 9,949,055 B2
(45) Date of Patent: Apr. 17, 2018

(54) SIGNAL CONTROL APPARATUS

(71) Applicant: KYUSHU INSTITUTE OF TECHNOLOGY, Fukuoaka (JP)

(72) Inventor: Yasushi Sato, Kitakyushu (JP)

(73) Assignee: KYUSHU INSTITUTE OF TECHNOLOGY, Fukuoaka (JP)

( * ) Notice: Subject to any disclaimer, the term of this patent is extended or adjusted under 35 U.S.C. 154(b) by 131 days.

(21) Appl. No.: 14/959,797

(22) Filed: Dec. 4, 2015

(65) Prior Publication Data

US 2016/0088418 A1 Mar. 24, 2016

Related U.S. Application Data

(63) Continuation of application No. PCT/JP2014/065259, filed on Jun. 9, 2014.

(30) Foreign Application Priority Data

Jun. 7, 2013 (JP) ..... 2013-120953

(51) Int. Cl.
*H04R 5/00* (2006.01)
*H04S 7/00* (2006.01)
(Continued)

(52) U.S. Cl.
CPC ..... *H04S 7/305* (2013.01); *G10K 11/346* (2013.01); *H04R 3/12* (2013.01); *H04R 2217/03* (2013.01); *H04S 2420/03* (2013.01)

(58) Field of Classification Search
CPC ..... H04S 3/02; H04S 7/305; H04S 2420/03; H04R 2217/03; H04R 1/347; H04R 3/12;
(Continued)

(56) References Cited

U.S. PATENT DOCUMENTS 4,213,085 A * 7/1980 Ramer ..... G01R 19/14 324/103 P
7,801,315 B2 * 9/2010 Watanabe ..... H04R 1/323 381/111
(Continued)

FOREIGN PATENT DOCUMENTS

JP 2003143686 A 5/2003
JP 2009260689 A 11/2009
JP 2009260690 A 11/2009

*Primary Examiner* — William A Jerez Lora
(74) *Attorney, Agent, or Firm* — Duquette Law Group, LLC

(57) ABSTRACT

A signal control apparatus comprises: a first delay unit that receives a modulated signal corresponding to a positive input signal component; a second delay unit that receives a modulated signal corresponding to a negative input signal component; transducers that receive signals from the delay units and that output, as ultrasonic waves, the received signals; a microphone that detects the ultrasonic waves outputted from the transducers; a waveform characteristic detection unit that integrates the detected ultrasonic waves, thereby detecting the waveform characteristics of the positive sonic wave and of the negative sonic wave; and a delay adjustment unit that inputs, based on the detected waveform characteristics, to the first delay unit or second delay unit, the information of a delay amount being in accordance with a phase difference between the signal outputted from the first delay unit and the signal outputted from the second delay unit to reduce the phase difference.

5 Claims, 13 Drawing Sheets

(51) Int. Cl.
*G10K 11/34* (2006.01)
*H04R 3/12* (2006.01)

(58) Field of Classification Search
CPC ..... G10K 2210/123; G10K 2210/3044; G10K 11/346
USPC ..... 381/17, 71.13, 89, 91, 97
See application file for complete search history.

(56) References Cited

U.S. PATENT DOCUMENTS

2002/0033734 A1* 3/2002 Broadley ..... H03F 1/32 330/251
2008/0031473 A1* 2/2008 Yarygin ..... H04S 7/302 381/97
2012/0008786 A1* 1/2012 Cronk ..... H04L 63/102 380/282
2012/0011567 A1* 1/2012 Cronk ..... H04L 63/102 726/4
2012/0131833 A1* 5/2012 Lippard ..... F41A 17/56 42/69.01
2012/0214575 A1* 8/2012 Amaitis ..... G06Q 50/34 463/25
2012/0235036 A1* 9/2012 Hatakeyama ..... G01N 23/2251 250/310
2013/0304481 A1* 11/2013 Briand ..... G10L 19/008 704/500
2014/0354352 A1* 12/2014 Noro ..... H03F 3/217 330/10

* cited by examiner (A)

(B)

(C)

Phase Control based on Peak Difference
(In this case, a control is made to make the delay of a transducer 12 faster than the delay of a transducer 11)

Phase Control based on Peak Difference
(In this case, a control is made to make the delay of the transducer 12 later than the delay of the transducer 11)

SIGNAL CONTROL APPARATUS

RELATED APPLICATIONS

This patent application is a continuation of, and claims the benefit of, PCT International Application No. PCT/JP2014/065259, filed on Jun. 9, 2014, entitled, "Signal Control Apparatus," which claims priority to Japanese Patent Application No. 2013-120953, filed on Jun. 7, 2013 the contents and teachings of each of which are hereby incorporated by reference in their entirety.

FIELD

The present invention relates to a signal control apparatus that makes a phase control of a high frequency sound signal.

BACKGROUND

An ultrasonic parametric loudspeaker has been used as a device with a high directivity that transmits sounds to a specific area. The ultrasonic parametric loudspeaker causes an energy transmitted by an ultrasonic sound wave to be converted into an audible sound in air due to non-linear characteristics, thus making it audible. If one wishes to make the direction of transmission of the sound variable, there is required a large-scale mechanism of such as inclining mechanically the sound generating surface.

With respect to these issues, for example, Patent Documents 1 and 2 disclose technical arts. Patent Document 1 discloses the technical art in which an AD converter samples a modulation signal, which is used to amplitude-modulate an ultrasonic sound wave, with a predetermined sampling frequency, to generate sequentially a sample of modulation signal, the sample of modulation signal as generated is stored by a storage unit, a readout unit reads-out a plurality of samples having predetermined time periods, of the sample of modulation signal, from the storage unit, an ultrasonic sound wave oscillator oscillates the ultrasonic sound wave signal, a plurality of amplitude modulators amplitude-modulates the ultrasonic sound wave signal with the use of a plurality of samples as read-out, to output a plurality of modulated signals, and a plurality of electro-acoustic converters is operated by the plurality of modulated signals.

Patent Document 2 discloses the technical art in which a sample generator generates sequentially a sample of modulated signal in which an ultrasonic sound wave signal has been amplitude-modulated with the modulation signal, the sample of modulated signal as generated is stored by a storage unit, a readout unit reads-out a plurality of samples having predetermined time periods, of the sample of modulation signal, from the storage unit, and a plurality of electro-acoustic converters is operated respectively by the plurality of samples.

Patent Documents

Patent Document 1: Japanese Patent Provisional Publication No. 2009-260689

Patent Document 2: Japanese Patent Provisional Publication No. 2009-260690.

SUMMARY

Subject to be Solved by the Invention

In case of a direction control of an ultrasonic parametric loudspeaker by a phase control, it is difficult to provide a sufficient direction control due to influence of reflection by reflection from a wall, a ceiling, a floor, etc. of external environment.

The technical arts of Patent Documents 1 and 2, both of which are technical art of carrying out a phase control, require complex calculations using temporal elements, thus making a processing complicated. In addition, if a sound velocity "c" is used in a calculation, such a sound velocity "c" varies with temperature, and the use of it as a fixed value would make it difficult to carry out an accurate calculation due to change in temperature. Even If it is not used as a fixed value, it is necessary to execute a processing of specify a sound velocity "c" corresponding to a temperature at that time, thus causing a problem of making the processing complicated.

The present invention is to provide a signal control apparatus, which permits to achieve a phase control with a high degree of accuracy by a simple structure and processing, without being subject to external environment.

Means to Solve the Subject

The signal control apparatus according to the present invention comprises: a delay unit for a first system, to which a modulation signal corresponding to a positive component of an input signal is to be inputted; a delay unit for a second system, to which a modulation signal corresponding to a negative component of the input signal is to be inputted; a transducer to which signals outputted from the delay units for the respective systems are to be inputted, and which outputs a signal in a form of an ultrasonic sound wave for the respective systems; a detection unit that detects the ultrasonic sound wave from the respective systems, which have been outputted from the transducers; a waveform characteristic detection unit that combines the ultrasonic sound waves for the respective systems, which have been detected by the detection unit, and detects respective waveform characteristics of a positive sound wave and a negative sound wave; and a delay adjustment unit that inputs, so that a phase difference between the signal outputted from the delay unit for the first system and the signal outputted from the delay unit for the second system decreases, based on the waveform characteristics detected by the waveform characteristic detection unit, information on an amount of delay in accordance with the phase difference to the delay unit for the first system or the delay unit for the second system.

The signal control apparatus according to the present invention, in which the delay units for the two systems are used so that the modulation signal corresponding to the positive component of the input signal is inputted to the one delay unit and the modulation signal corresponding to the negative component of the input signal is inputted to the other delay unit, the ultrasonic sound waves outputted from the respective delay units are detected, and the information on the amount of delay is fed back from the waveform characteristics when combining the ultrasonic sound waves, so as to decrease the phase difference between the signals in this manner, can provide an effect of permitting to achieve the phase control with a high degree of accuracy in a simplified configuration and by merely carrying out a simple processing.

In the signal control apparatus according to the present invention, the waveform characteristic detection unit may detect a peak of the positive sound wave and a peak of the negative sound wave, respectively; and the delay adjustment unit may comprise: an addition section that adds the peak of the positive sound wave and the peak of the negative sound wave; and a delay-amount determination section that inputs the information on the amount of delay to the delay unit for the first system or the delay unit for the second system, in accordance with positive or negative of the signal obtained from results of addition.

The signal control apparatus according to the present invention, in which the waveform characteristic detection unit detects the peak of the positive sound wave and the peak of the negative sound wave, respectively, the delay adjustment unit adds the respective peaks, and the information on the amount of delay is inputted to the delay unit in accordance with positive or negative of the signal obtained from results of addition in this manner, can provide an effect of permitting to calculate an appropriate amount of delay with which a feedback processing is to be carried out, in a simplified configuration and by merely carrying out a simple processing. More specifically, it is possible to reduce costs and achieve a high-performance signal control.

In the signal control apparatus according to the present invention, the waveform characteristic detection unit may detect a peak of the positive sound wave and a peak of the negative sound wave, respectively; and the delay adjustment unit may calculate a ratio of a component value of a peak of the positive sound wave and a component value of a peak of the negative sound wave, and input the information on the amount of delay in accordance with the ratio to the delay unit for the first system or the delay unit for the second system.

The signal control apparatus according to the present invention, in which the waveform characteristic detection unit detects the peak of the positive sound wave and the peak of the negative sound wave, respectively; and the delay adjustment unit calculates the ratio of the component value of the peak of the positive sound wave and the component value of the peak of the negative sound wave, and inputs the information on the amount of delay in accordance with the ratio to the delay unit, in this manner, can provide an effect of permitting to calculate an appropriate amount of delay with which a feedback processing is to be carried out, in a simplified configuration and by merely carrying out a simple processing.

In the signal control apparatus according to the present invention, the waveform characteristic detection unit may detect a duty ratio; and the delay adjustment unit may input the information on the amount of delay in accordance with the duty ratio to the delay unit for the first system or the delay unit for the second system.

The signal control apparatus according to the present invention, in which the waveform characteristic detection unit detects the duty ratio and the information on the amount of delay in accordance with the duty ratio is inputted to the delay unit, in this manner, can provide an effect of permitting to calculate an appropriate amount of delay with which a feedback processing is to be carried out, in a simplified configuration and by merely carrying out a simple processing.

The signal control apparatus according to the present invention may further comprise: a selection unit that allocates the signal to the delay unit for the first system or the delay unit for the second system, in synchronization with a zero cross signal of the input signal.

The signal control apparatus according to the present invention, in which the signal is allocated to the delay unit for the first system or the delay unit for the second system, in synchronization with a zero cross signal of the input signal, in this manner, can provide an effect of permitting to input accurately the appropriate signal to the respective delay unit.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Figure 1:
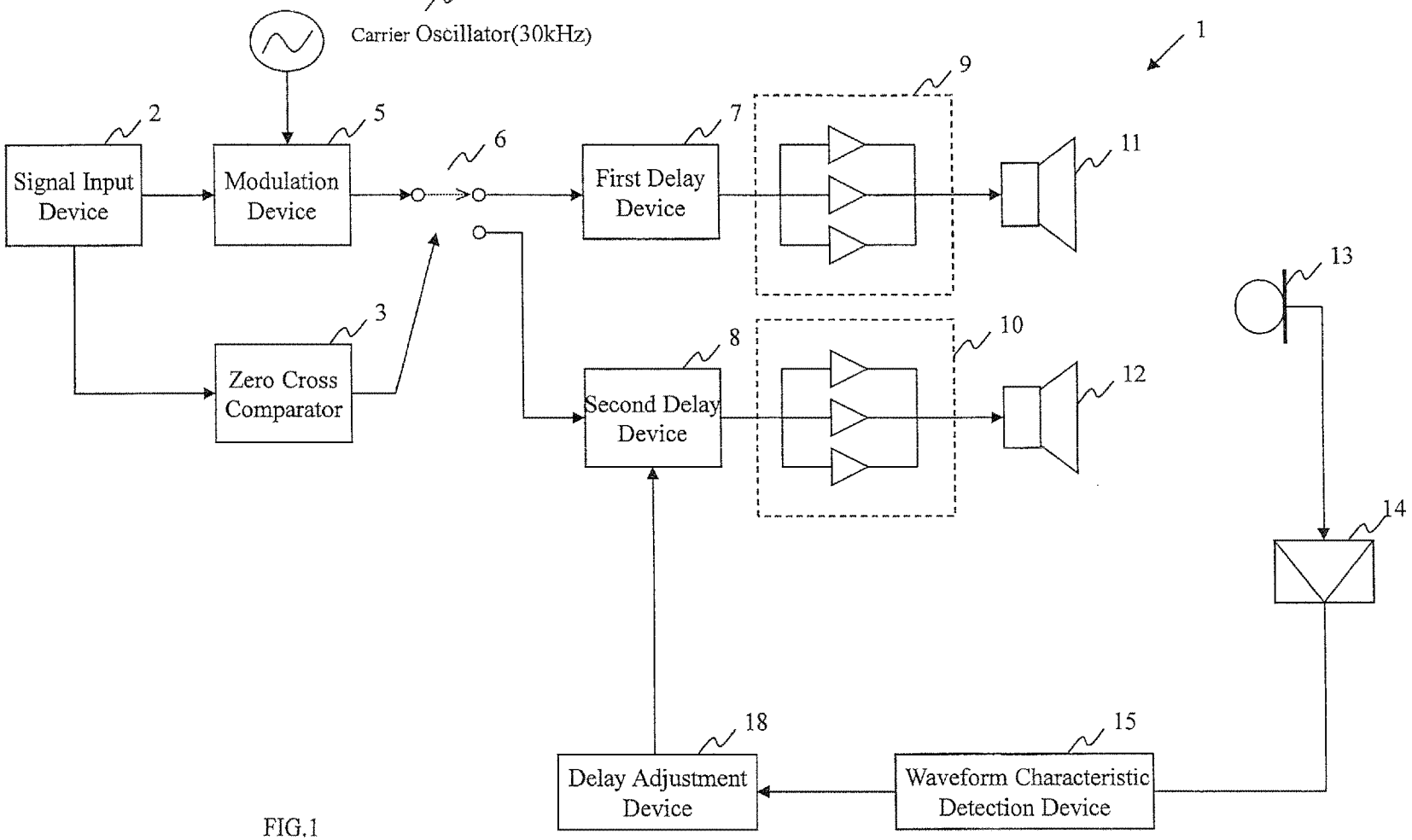
FIG. 1 is a block diagram illustrating a configuration of a signal control apparatus according to the first embodiment of the present invention.

Now, the embodiment of the present invention will be described below with reference to FIGS. 1 to 9 as indicated above The same reference numeral is allotted to the corresponding same structural component through the embodiments of the present invention.

The First Embodiment of the Present Invention

The signal control apparatus according to the embodiment of the present invention will be described with reference to FIG. 1 to FIG. 8. The signal control apparatus according to the present invention, in which a direction control of directivity of an ultrasonic parametric loudspeaker is electrically made by controlling a phase, enables an accurate direction control to be made with a simple structure at a low cost, without being influenced by an external environment (for example, reflection, interference, variation of a sound velocity due to a temperature change).

FIG. 1 is a block diagram illustrating a configuration of the signal control apparatus according to the embodiment of the present invention. The signal control apparatus according to the embodiment of the present invention has an integral structure with a pair of ultrasonic parametric loudspeakers (comprising two transducers), in which common ultrasonic wave signals are inputted from a plurality of elements as provided, in each loudspeaker.

The signal control apparatus 1 is provided with a signal input device 2 to which an arbitrary input signal is to be inputted; a modulation device 5 that modulates the input signal with a signal of a carrier oscillator (e.g. 30 kHz); a zero cross comparator 3 that detects a zero crossing of the input signal; a switching device 6 that makes the switching in accordance with a detection by the zero cross comparator 3; the first delay device 7 that makes a phase control of a positive component of the input signal; the second delay device 8 that makes a phase control of a negative component of the input signal; a plurality of amplifiers 9, 10 that amplify the signals outputted from the respective delay devices; transducers 11, 12 that are driven by the signals amplified by the amplifiers 9, 10 to output ultrasonic sound waves; a microphone 13 that combines the ultrasonic sound waves outputted from the respective transducers 11, 12, into a sound wave signal of an audible sound for detection; a microphone amplifier 14 that amplifies the sound wave signal as detected; a waveform characteristic detection device 15 that detects a waveform characteristics of a positive sound wave and a waveform characteristics of a negative sound wave of the signal waveform of the sound wave signal as detected; and a delay adjustment device 18 that calculates an amount of delay for controlling a phase from the waveform characteristics as detected and inputs the same to the second delay device to make the phase control.

Figure 2:
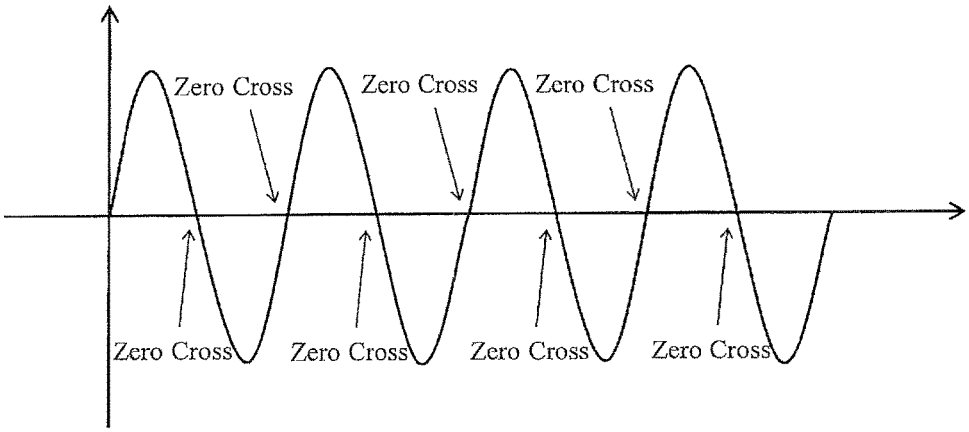
FIG. 2 is a figure illustrating an example of a waveform of an input signal.

The embodiment of the present invention will be described as a case where a sine wave as shown in FIG. 2 is used as the input signal, in order to facilitate understanding. However, it is possible to apply the signal control according to the embodiment of the present invention even to a complicated signal waveform such as a normal sound.

The input signal as inputted to the signal input device 2 is modulated by the modulation device 5. The modulation processing by the modulation device 5 may be any one of modulations such as an AM (Amplitude Modulation), a FM (Frequency Modulation), an SSB (Single Side Band) Amplitude Modulation, a DSB (Double Side Band) Amplitude Modulation, etc. The input signal is inputted to the zero cross comparator 3 and the cero crossing is detected by it (see FIG. 2). The switching device 6 makes the switching in synchronization with the zero crossing as detected, and the modulation signal corresponding to the positive component of the input signal is inputted to the first delay device 7, and the modulation signal corresponding to the negative component of the input signal is inputted to the second delay device 8.

Figure 3:
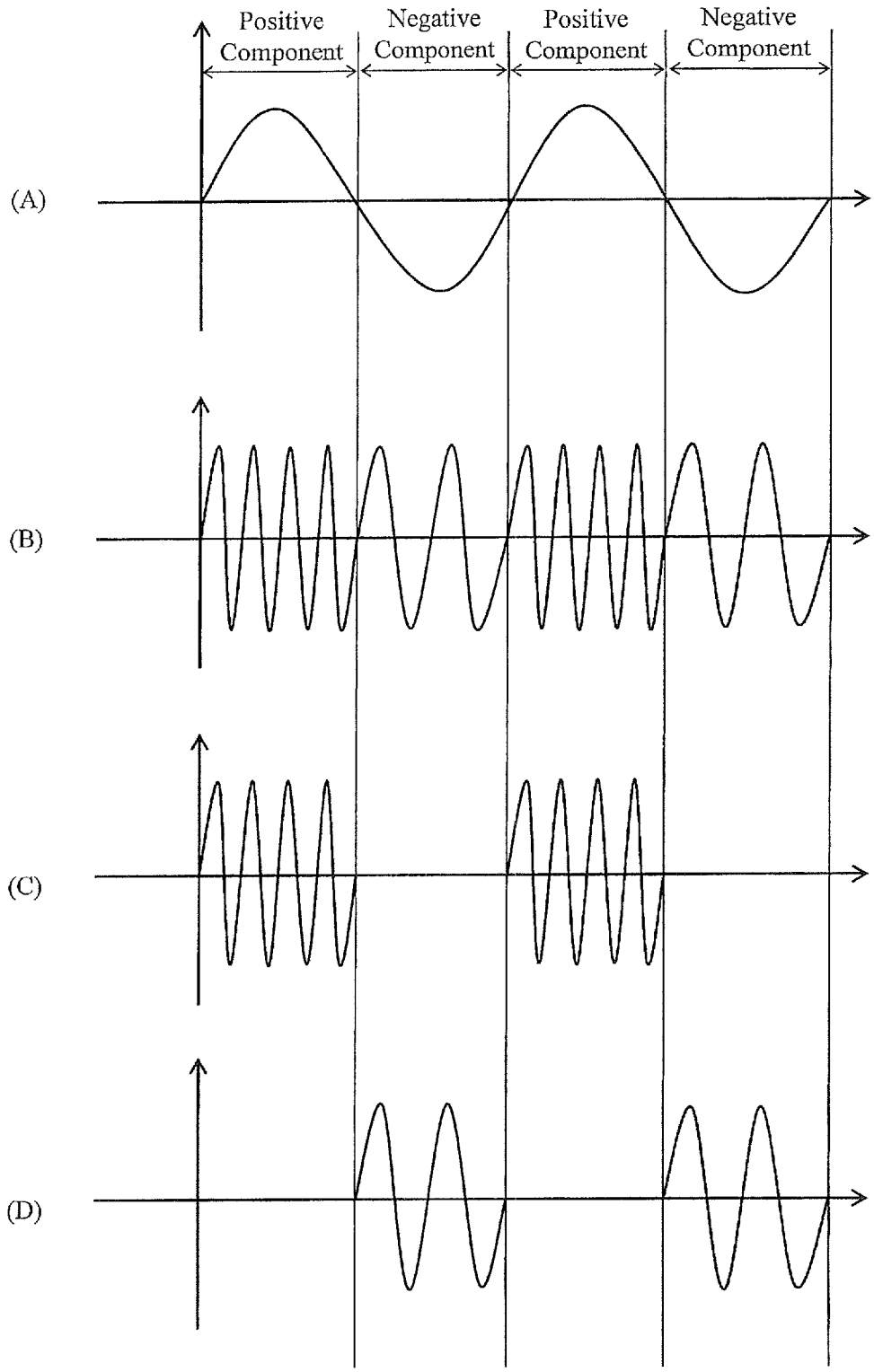
FIG. 3 is a figure illustrating a modulation signal inputted to the respective delay unit.

FIG. 3 is a figure illustrating the modulation signal inputted to the respective delay unit. It is assumed that the input signal is frequency-modulated by the modulation device 5. FIG. 3(A) shows the input signal, FIG. 3(B) shows the modulation signal, FIG. 3(C) shows the modulation signal of the positive component as inputted to the first delay device 7, and FIG. 3(D) shows the modulation signal of the negative component as inputted to the second delay device 8. The switching is made in synchronization with the zero crossing as detected, as shown in FIGS. 3(D) and (D), with the result that the modulation signal of the positive component is inputted to the first delay device 7 and the modulation signal of the negative component is inputted to the second delay device 8.

The signals, which have been inputted to the respective delay devices, are inputted through the amplifiers 9, 10 to the transducers 11, 12, respectively, and then outputted in the form of ultrasonic sound wave. The ultrasonic sound waves as outputted from the transducers 11, 12, respectively, are detected by the microphone 13 and then demodulated and combined into a single waveform. At this time, the microphone 13 cannot normally detect the respective phase, since it cannot distinguish the signal waveform outputted from the transducer 11 from the signal waveform outputted from the transducer 12. So, only a distortion of the signal corresponding to the phase difference caused by a position of the microphone is detected.

Figure 4:
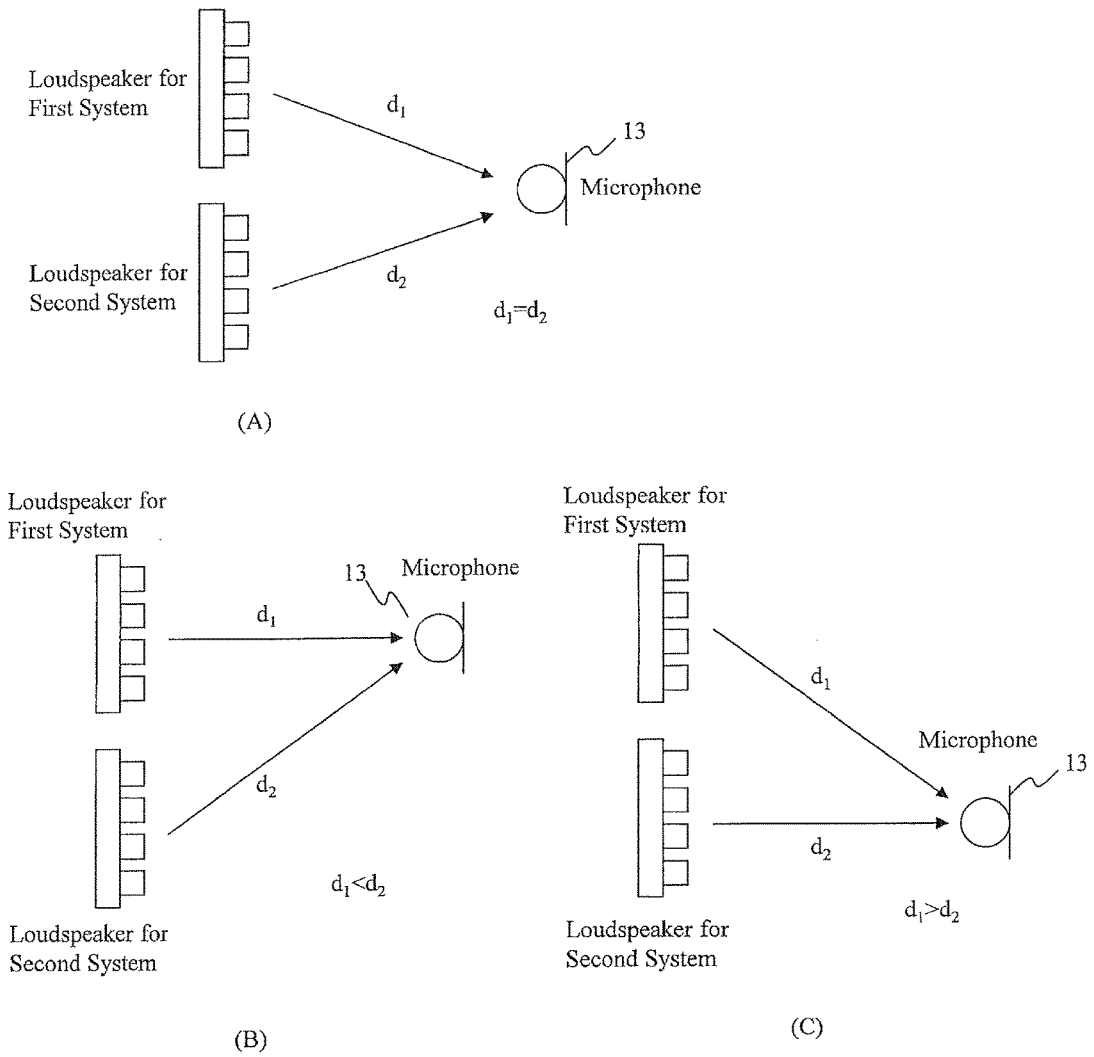
FIG. 4 is a figure illustrating a positional relationship between a phase difference and a microphone.
Figure 5:
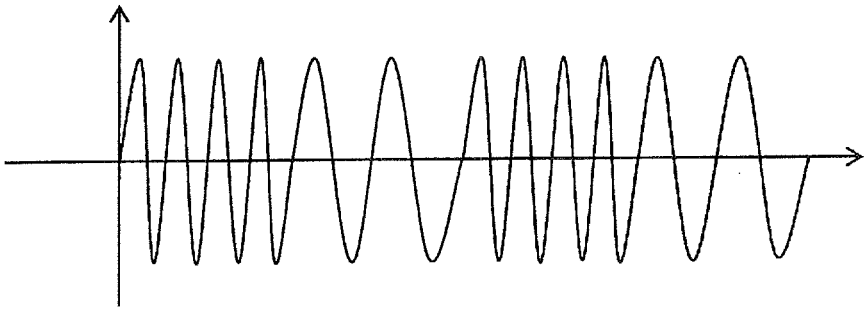
FIG. 5 is a figure illustrating schematically a signal waveform as combined, of a respective loudspeaker, immediately before detection by a microphone (before demodulation)
Figure 5:
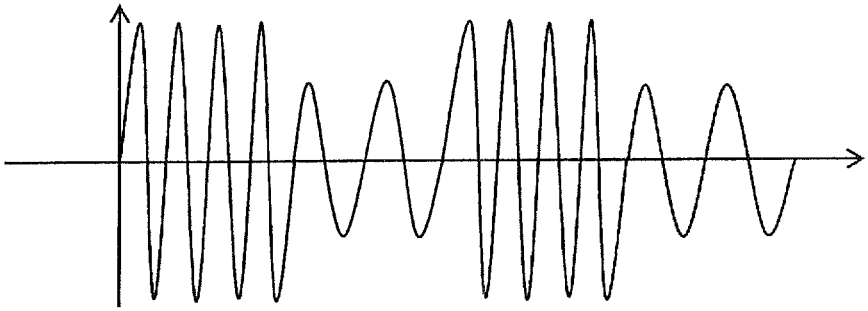
Figure 5:
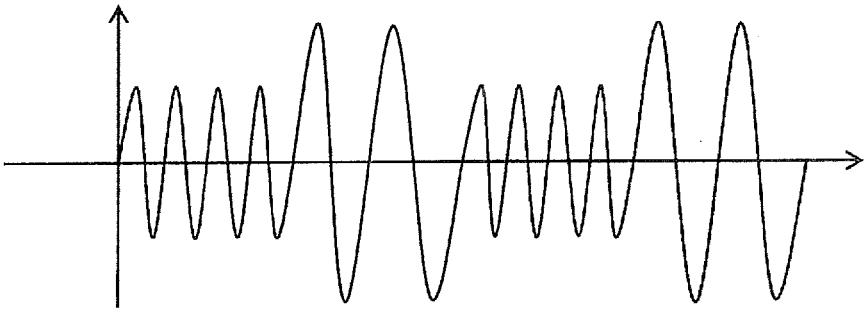
Figure 6:
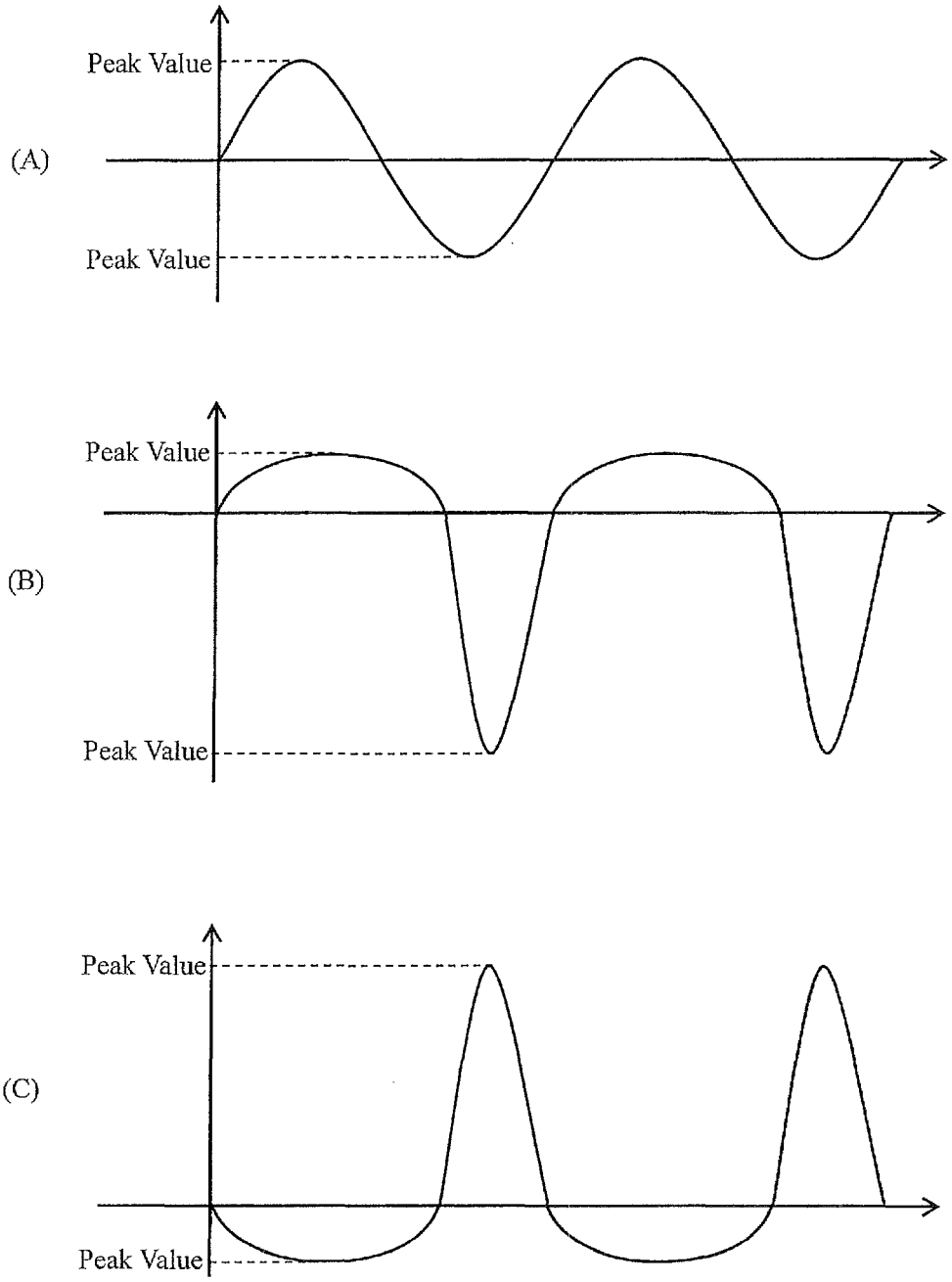
FIG. 6 is a figure illustrating a signal waveform as combined, immediately after detection by the microphone (after demodulation)

FIG. 4 is a figure illustrating a positional relationship between the phase difference and the microphone, FIG. 5 is a figure illustrating schematically a signal waveform as combined, of the respective loudspeaker, immediately before detection by the microphone 13 (before demodulation), and FIG. 6 is a figure illustrating the signal waveform as combined, immediately after detection by the microphone 13 (after demodulation).

When the ultrasonic sound wave signals outputted from the respective loudspeakers are inputted to the loudspeaker in a state where their phase are matched with each other, as shown in FIG. 4(A), and more specifically, in case of $d_1=d_2$, where "$d_1$" denotes a distance between the loudspeaker on the side of the first delay device 7 (hereinafter referred to as the "loudspeaker for the first system") and the microphone 13, and "$d_2$" denotes a distance between the loudspeaker on the side of the second delay device 8 (hereinafter referred to as the "loudspeaker for the second system") and the microphone 13, the signal waveform becomes one as demodulated in the same manner as the input signal as shown in FIG. 5(A), and after demodulation, there is detected the sine wave having the same form as the input signal as shown in FIG. 6(A).

In case of the positional relationship of the microphone 13 of $d_1<d_2$, as shown in FIG. 4(B), the signal as outputted from the transducer 11 becomes stronger and the signal as outputted from the transducer 12 becomes weaker, and the phases of the ultrasonic sound wave signals outputted from the respective transducers are shifted from each other, the signal becomes the demodulated signal as shown in FIG. 5(B), and after demodulation, the waveform is detected as distorted as shown in FIG. 6(B).

The waveform of FIG. 6(B) shows a state where the DC component has been removed, and there appear sharp peaks in the negative component. More specifically, when the phase of the signal as outputted from the transducer 11 is shifted from the phase of the signal as outputted from the transducer 12 in this manner, it is not possible to catch the signal as an accurate input signal.

In the same way, in case of the positional relationship of the microphone 13 of $d_1>d_2$, as shown in FIG. 4(C), the signal as outputted from the transducer 12 becomes stronger and the signal as outputted from the transducer 11 becomes weaker, and the phases of the ultrasonic sound wave signals outputted from the respective transducers are shifted from each other, the signal becomes the demodulated signal as shown in FIG. 5(C), and after demodulation, the waveform is detected as distorted as shown in FIG. 6(C), and it is not possible to catch the signal as an accurate input signal in the same manner as FIG. 6(B).

More specifically, the waveform to be detected may change from the state of FIG. 6(A) to FIG. 6(B) or FIG. 6(C), in accordance with the position of the microphone. It is possible to prevent the phase from being shifted and match the phases with each other by adjusting the amount of delay of the delay device (any one or both of the first delay device 7 and the second delay device 8), even when the phase is shifted as shown in FIG. 4(B) and FIG. 4(C). The signal waveform of FIG. 5 is not the waveform as actually detected by the microphone 13, but the waveform as schematically shown for description.

Figure 7:
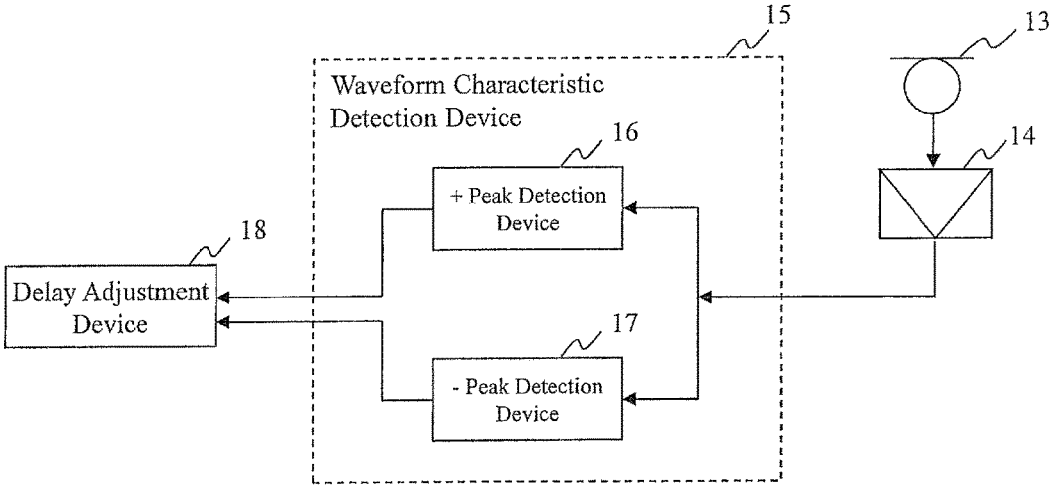
FIG. 7 is a block diagram illustrating a configuration of a waveform characteristic detection device according to the first embodiment of the present invention.
Figure 8:
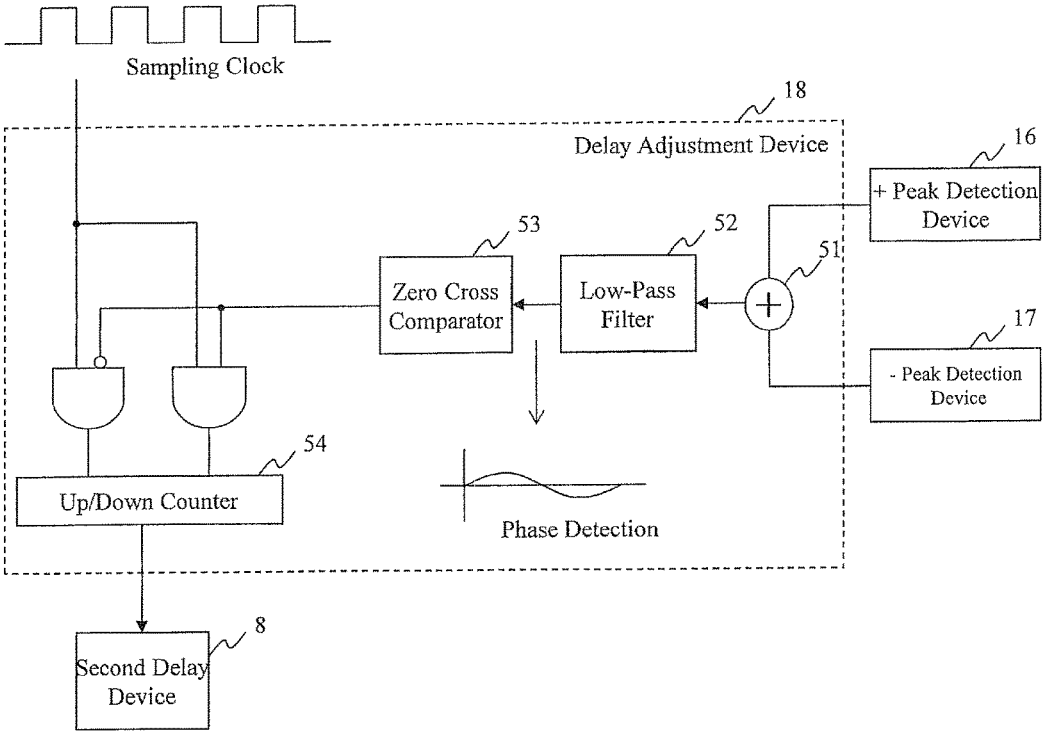
FIG. 8 is a block diagram illustrating a configuration of a delay adjustment device according to the first embodiment of the present invention.

Now, description will specifically be given below of a method of making adjustment of the amount of delay in the embodiment of the present invention. Here, the amount of delay as adjusted is determined with the use of the positive peak and the negative peak of the signal wave as detected by the microphone 13. FIG. 7 is a block diagram illustrating a configuration of a waveform characteristic detection device according to the embodiment of the present invention, and FIG. 8 is a block diagram illustrating a configuration of a delay adjustment device according to the embodiment of the present invention. In FIG. 7, the waveform characteristic detection device 15 is provided with a + peak detection section 16 that detects the positive peak from the signal waveforms (the waveforms as shown in FIG. 6) as detected by the microphone 13, and a – peak detection section 17 that detects the negative peak. By using the respective peaks as detected here, there is calculated the amount of delay adjusted by the delay adjustment device 18.

More specifically, in case where the value of the negative peak is large, and the value of the positive peak is small, as shown in FIG. 6(B), the amount of delay of the delay device (here, the second delay device 8) is calculated so as to decrease the value of the negative peak and increase the value of the positive peak. In case of FIG. 6(C) where the value of the negative peak is small, and the value of the positive peak is large, the amount of delay of the second delay device 8 is calculated so as to increase the value of the negative peak and decrease the value of the positive peak. The amount of delay as calculated is inputted to the second delay device 8, thus making adjustment of the amount of delay. It is possible to make accurately the direction control of directivity by making adjustment so that a ratio of the value of the positive peak and the value of the negative peak becomes 1:1 as shown in FIG. 6(A), and namely the coherency comes to a zero.

Thus, it is possible to make an accurate phase control in a simple manner only with the ratio of the peak values of the combined waveform as detected by the microphone 13, without performing a complicated processing in which the phases of the ultrasonic sound wave signals outputted from the respective transducers 11, 12 are detected in a time relationship and then a detail analysis is made.

Now, description will be given of a specific processing of the delay adjustment device 18 as shown in FIG. 8. In FIG. 8, the delay adjustment device 18 is provided with an addition section 51 that adds a peak value detected by the + peak detection section 16 to a peak value detected by the – peak detection section 17, a low-pass filter 52 that extracts a low frequency component from the signal as added to detect a phase, a zero cross comparator 53 that detects a zero crossing of a waveform, as detected, and an up/down counter 54 that performs a counting processing in accordance with a positive or negative value in synchronization with the zero cross as detected and a sampling clock.

More specifically, in case of the waveform as shown in FIG. 6(B), the negative value is detected by adding the respective peak values to each other, the up/down counter 54 counts down and then the amount of delay of the second delay device 8 is adjusted so as to become later in accordance with the count-down. To the contrary, in case of the waveform as shown in FIG. 6(C), the positive value is detected by adding the respective peak values to each other, the up/down counter 54 counts up and then the amount of delay of the second delay device 8 is adjusted so as to become faster in accordance with the count-up.

If the amount of delay of the first delay device 7 is a zero, when adjusting the amount of delay of the second delay device 8 in the manner as described above, it is difficult to adjust the amount of delay of the second delay device 8 to become faster. Accordingly, a previous adjustment of the amount of delay of the first delay device 7 with a predetermined amount of delay (for example, 100 ms, etc.), which adjustment is made so that the amount of delay becomes later, permits the adjustment of the amount of delay of the second delay device 8 (by for example, 70 ms, etc.) so as to make relatively faster than the first delay device 7.

The Second Embodiment of the Present Invention

The signal control apparatus according to the embodiment of the present invention will be described with reference to FIG. 9 to FIG. 12. In this embodiment of the present invention, there is omitted description of the same structural components as the first embodiment of the present invention as described above. With respect to the signal control apparatus according to the embodiment of the present invention, there will be given a specific description of a processing in which a kind of modulation is not specifically defined. This embodiment of the present invention also results finally in obtainment of the same waveform as the first embodiment of the present invention.

Figure 9:
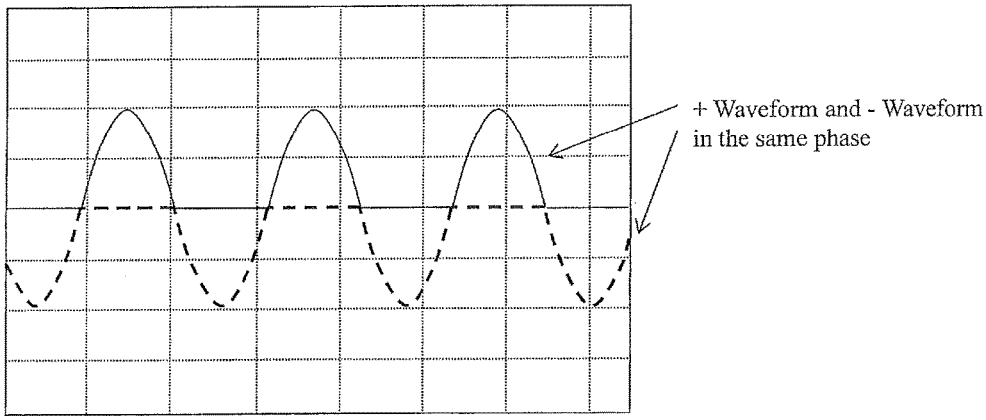
FIG. 9 is a figure illustrating a waveform as outputted from a transducer in the signal control apparatus according to the second embodiment of the present invention.
Figure 10:
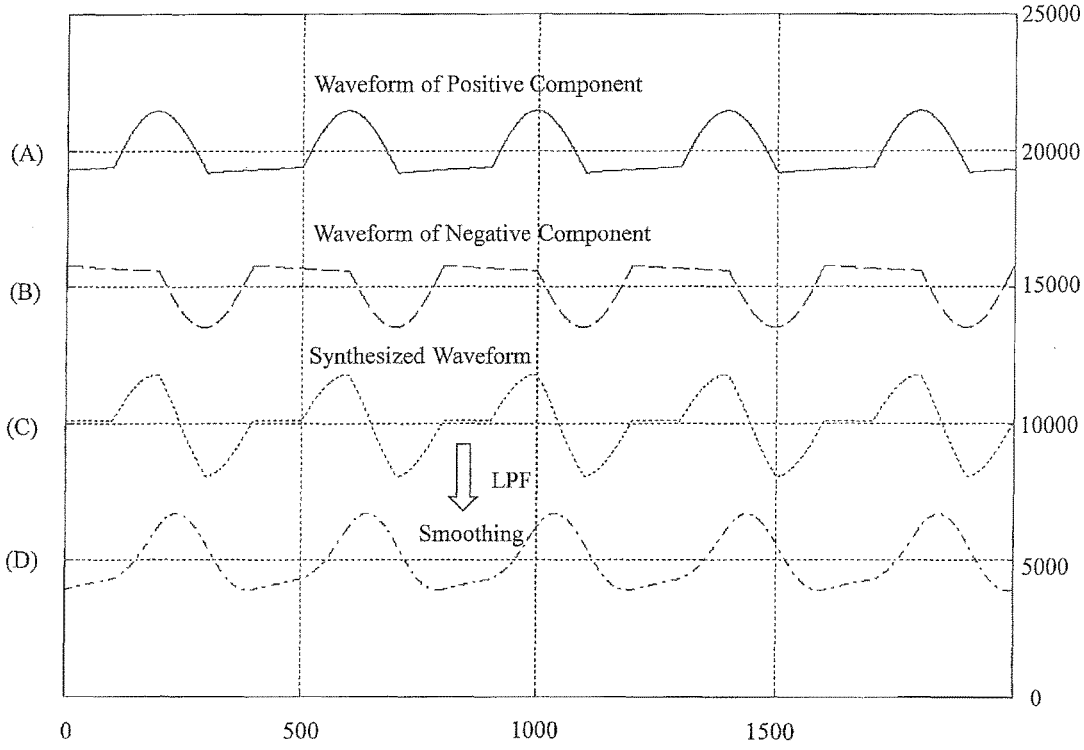
FIG. 10 is the first figure illustrating a waveform as detected by the microphone in the signal control apparatus according to the second embodiment of the present invention.
Figure 11:
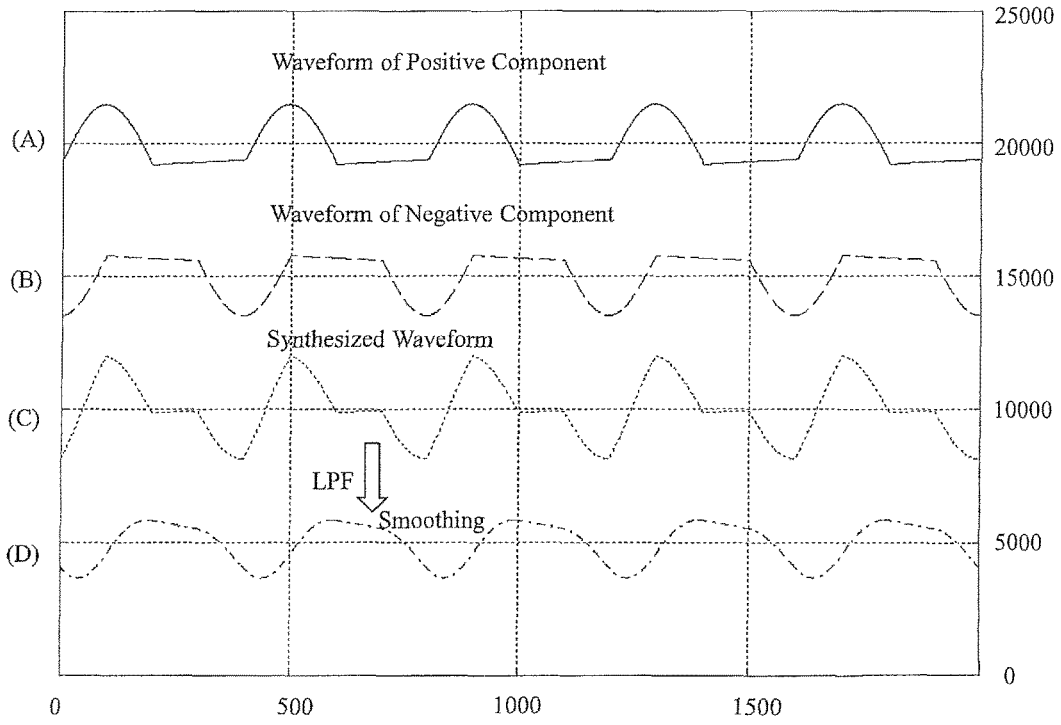
FIG. 11 is the second figure illustrating a waveform as detected by the microphone in the signal control apparatus according to the second embodiment of the present invention.

FIG. 9 is a figure illustrating the waveforms of the signals outputted from the transducer 11 and the transducer 12 in the signal control apparatus according to the embodiment of the present invention. The positive waveform as shown in solid line shows the waveform of the signal as outputted from the transducer 11, and the negative waveform as shown in broken line shows the waveform of the signal as outputted from the transducer 12. When the microphone 13 is positioned so that the distances from the respective transducer 11 and transducer 12 become same, and more specifically, in the position having the relationship of $d_1=d_2$, as shown in FIG. 4(A), the respective waveforms have the same phase as shown in FIG. 9, and the a clear sine wave is detected.

To the contrary, the position of the microphone 13 having the relationship of $d_1>d_2$, as shown in FIG. 4(C), causes a phase difference between the respective waveforms as shown in FIGS. 10(A) and (B) (FIG. 10(A) shows the waveform of the signal outputted from the transducer 11, and FIG. 10(B) shows the waveform of the signal outputted from the transducer 12), and more specifically, the phase shifting occurs. Here, the distance of $d_1$ is longer, and the waveform outputted from the transducer 11 is later than the waveform outputted from the transducer 12. The respective waveforms are combined by the microphone 13 in the manner as shown in FIG. 10(C) and then, after passing through the low-pass filter, the waveform as shown in FIG. 10(D) is detected. In FIG. 10(D), the sharp peaks appear on the positive side, and the peaks on the negative side are distorted, leading to a smaller value. This corresponds to the waveform as shown in FIG. 6(C), and the same waveform as in the frequency modulation is obtained.

On the other hand, the position of the microphone 13 having the relationship of $d_1<d_2$, as shown in FIG. 4(B), causes a phase difference between the respective waveforms as shown in FIGS. 11(A) and (B) (FIG. 11(A) shows the waveform of the signal outputted from the transducer 11, and FIG. 11(B) shows the waveform of the signal outputted from the transducer 12), and more specifically, the phase shifting occurs. Here, the distance of $d_1$ is shorter, and the waveform outputted from the transducer 11 is faster than the waveform outputted from the transducer 12. The respective waveforms are combined by the microphone 13 in the manner as shown in FIG. 11(C) and then, after passing through the low-pass filter, the waveform as shown in FIG. 11(D) is detected. In FIG. 11(D), the sharp peaks appear on the negative side, and the peaks on the positive side are distorted, leading to a smaller value. This corresponds to the waveform as shown in FIG. 6(B), and the same waveform as in the frequency modulation is obtained.

Figure 12:
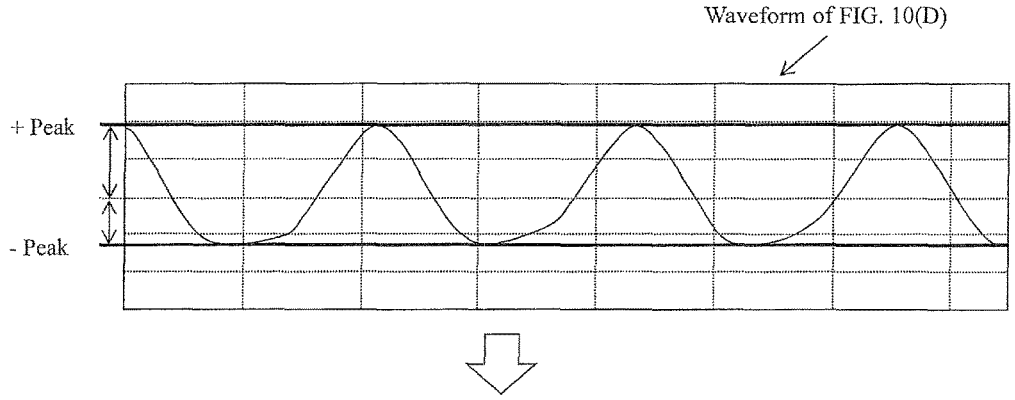
FIG. 12 is a figure illustrating a peak detection in the signal control apparatus according to the second embodiment of the present invention.
Figure 12:
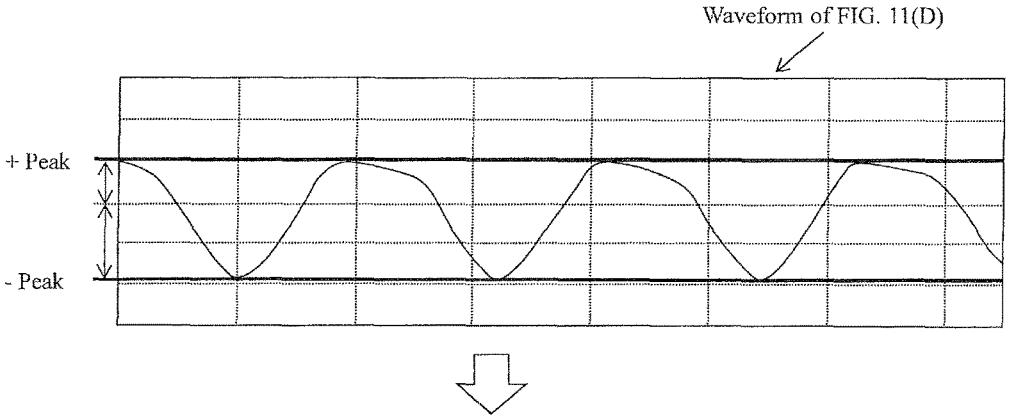

With respect to the waveforms obtained by the microphone 13 (FIG. 10(D) and FIG. 11(D), the + peak detection section 16 and the − peak detection section 17 detect the respective peaks, as shown in FIG. 12. After the detection of the peaks, it is possible to control the delay by carrying out the same processing as that described above.

The Third Embodiment of the Present Invention

The signal control apparatus according to the embodiment of the present invention will be described with reference to FIG. 13. The signal control apparatus according to the embodiment of the present invention calculates information on the amount of delay from the ratio of the peak values, and control the second delay device 8 in accordance with the above-mentioned amount of delay. In this embodiment of the present invention, there is omitted description of the same structural components as the above-described embodiments of the present invention as described above.

Figure 13:
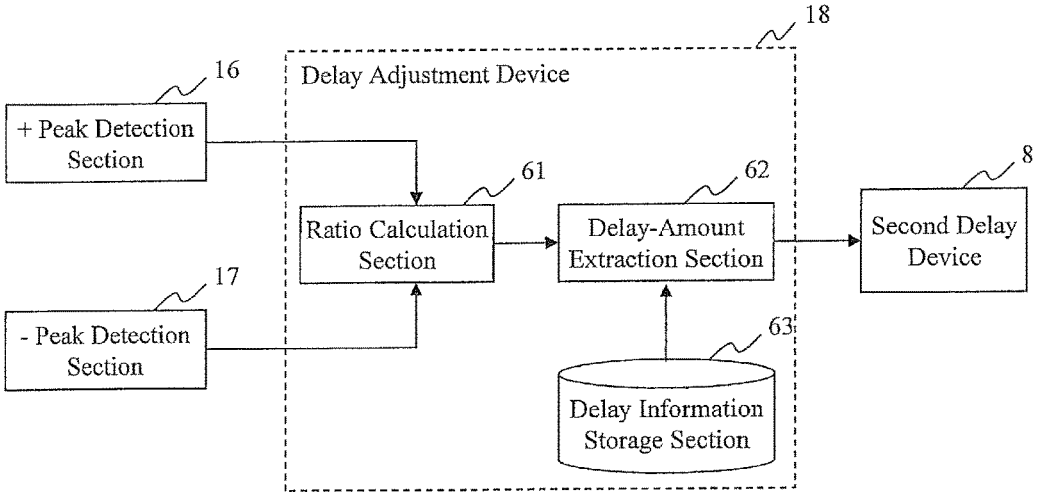
FIG. 13 is a block diagram illustrating a configuration of a delay adjustment device according to the third embodiment of the present invention.

In the embodiment of the present invention, the delay adjustment device 18 has a configuration as shown in FIG. 13. More specifically, it is provided with a ratio calculation section 61 that calculates a ratio of the peak value as detected by the + peak detection section 16 and the peak value as detected by the − peak detection section 17 (absolute values of the peak values), and with a delay-amount extraction section 62 that extracts the information on the amount of delay corresponding to the ratio as calculated, from a delay information storage section 62. The delay information storage section 62 has a configuration in which there are stored the ratio of the peak values as previously measured in accordance with the position of the microphone 13, as well as the amount of delay for matching the phase based on the above-mentioned ratio, in association with it, and the ratio of the peak value is calculated, thus permitting to obtain the amount of delay. The information on the amount of delay as obtained is inputted to the second delay device 8, so as to adjust the phase. For example, a memory and a CPU may be used in order to store the information or achieve the calculation.

Other Embodiment

The other embodiment of the present invention will be described. Here, the second method of adjusting the amount of delay will be described. In the second method, the amount of delay for adjustment is determined with the use of a duty ratio of the signal waveform as detected by the microphone 13 in the different manner from that of the first embodiment of the present invention. More specifically, the waveform characteristic detection device 15 calculates the duty ratio of the signal waveform as detected by the microphone 13, and the delay adjustment device 18 calculates the amount of delay for adjustment in accordance with the duty ratio as calculated.

With respect to the processing of the delay adjustment device 18 in the second method, the counting-up/counting-down processing may be performed in accordance with the duty ratio, and the amount of delay for the delay device may be adjusted in accordance with the resulting count, in the same manner as the case where the amount of delay is calculated from the difference between the positive peak and the negative peak, with the use of the counter, as shown in FIG. 8.

In addition, the amount of delay for the delay device may be adjusted based on the delay information storage section 63 in which the duty ratio as previously measured in accordance with the position of the microphone 13 and the amount of delay for adjusting the phase based on the duty ratio are stored in association with each other, in the same manner as the case where the information on the corresponding amount of delay is extracted from the ratio of the positive peak and the negative peak, as shown in FIG. 13.

According to the embodiments of the present invention as described above, any one of the method permits to achieve the accurate phase adjustment in accordance with the position of the microphone 13. In addition, it is possible to remarkably simplify the circuit configuration and achieve the phase adjustment at low costs with a high degree of accuracy.

In the description of each of the embodiments of the present invention, the sine wave is used as the input signal. However, it is possible to apply the signal control according to the embodiment of the present invention even to any type of signal of sound wave signal. Even when a human voice is used as the input signal, it is possible to make a signal control providing the same effects, in the exact same processing in the case where the sine wave is used as the input signal.

In addition, a configuration in which a user (a person who listens to the sound outputted from the ultrasonic sound loudspeaker) holds the microphone 13 (for example, a wireless microphone) and the microphone 13 is also moved together with the movement of the user, enables the directivity of the ultrasonic sound loudspeaker to be controlled so as to follow the movement of the user. More specifically, it is possible to always transmit the sound wave only to the user, even when the user moves.

In the above descriptions, the positional relationship between the loudspeaker and the microphone is limited to the two-dimensional plane (the two-dimensional plane in a horizontal direction relative to the ground surface). However, placing the loudspeaker in the longitudinal direction (i.e., a perpendicular direction to the ground surface) makes it possible to make the phase control also in a height direction. In addition, the combination of a pair of loudspeakers placed parallelly in the horizontal direction and another pair of loudspeakers placed parallelly in the vertical direction makes it possible to make the phase control in a three-dimensional manner.

Further, a configuration in which three or more loudspeakers are placed (not placed linearly) and the amount of delay for each of the loudspeakers is adjusted, also makes it possible to make the phase control in a three-dimensional manner.

While various embodiments of the innovation have been particularly shown and described, it will be understood by those skilled in the art that various changes in form and details may be made therein without departing from the spirit and scope of the innovation as defined by the appended claims.

DESCRIPTION OF REFERENCE NUMERALS

1 signal control apparatus
2 signal input device
3 zero cross comparator
4 carrier oscillator
5 modulation device
6 switching device
7 first delay device
8 second delay device
9, 10 amplifier
11, 12 transducer
13 microphone
14 microphone amplifier
16 + peak detection section
17 – peak detection section
18 delay adjustment device
51 addition section
52 low-pass filter
53 zero cross comparator
54 counter
61 ratio calculation section
62 delay-amount extraction section
63 delay information storage section

What is claimed is:

1. A signal control apparatus comprising:

a first delay device that controls a phase of a first modulation signal corresponding to a positive component of an input signal, the positive component of the input signal being defined as a portion having a positive value of displacement in a waveform of the input signal;

a second delay device that controls a phase a second modulation signal corresponding to a negative component of the input signal, the negative component of the input signal being defined as a portion having a negative value of displacement in a waveform of the input signal;

a first transducer that receives the first modulation signal outputted from the first delay device and outputs a first ultrasonic sound wave;

a second transducer that receives the second modulation signal outputted from the second delay device and outputs a second ultrasonic sound wave;

a microphone that detects the first and second ultrasonic sound waves outputted from the respective transducers and outputs a combined sound wave signal thereof;

a waveform characteristic detection device that detects a waveform characteristic of the combined sound wave signal outputted from the microphone; and a delay adjustment device that controls an amount of delay for either one of the first delay device and the second delay device, such that a phase difference between the first signal outputted from the first delay device and the second signal outputted from the second delay device decreases, based on the waveform characteristic detected by the waveform characteristic detection device.

2. The signal control apparatus as claimed in claim 1, wherein:

the waveform characteristic detection device detects a positive peak value of a positive component of the combined sound wave signal and a negative peak value of a negative component of the combined sound wave signal; and the delay adjustment device comprises:

an adder that adds the positive peak value and the negative peak value detected by the waveform characteristic detection device; and a delay-amount determiner that determines the amount of delay by which the either one of the first delay device and the second delay device is controlled, in accordance with positive and negative of a result of addition by the adder.

3. The signal control apparatus as claimed in claim 1, wherein:

the waveform characteristic detection device detects a positive peak value of a positive component of the combined sound wave signal and a negative peak value of a negative component of the combined sound wave signal; and the delay adjustment device calculates a ratio of the positive peak value and the negative peak value detected by the waveform characteristic detection device, and controls the amount of delay for the either one of the first delay device and the second delay device in accordance with the calculated ratio.

4. The signal control apparatus as claimed in claim 1, wherein:

the waveform characteristic detection device detects a duty ratio of the combined sound wave signal outputted from the microphone; and the delay adjustment device controls the amount of delay for the either one of the first delay device and the second delay device in accordance with the duty ratio detected by the waveform characteristic detection device.

5. The signal control apparatus as claimed in any one of claims 1 to 4, further comprising:

a selector that switches the first and second modulation signals to the first and second delay devices, respectively, in synchronization with a detection of a zero cross of the input signal.

* * * * *